US007178175B2

(12) United States Patent
Rogers et al.

(10) Patent No.: US 7,178,175 B2
(45) Date of Patent: Feb. 20, 2007

(54) RETENTION SYSTEM FOR SAFETY HELMET

(75) Inventors: David C. Rogers, Boston, MA (US); Duco W. Noordzij, Roxbury, MA (US); Charles H. Rogers, Halifax, MA (US)

(73) Assignee: Artisent, Inc., Boston, MA (US)

( * ) Notice: Subject to any disclaimer, the term of this patent is extended or adjusted under 35 U.S.C. 154(b) by 12 days.

(21) Appl. No.: 10/940,944

(22) Filed: Sep. 14, 2004

(65) Prior Publication Data

US 2005/0210567 A1 Sep. 29, 2005

Related U.S. Application Data

(60) Provisional application No. 60/557,093, filed on Mar. 26, 2004.

(51) Int. Cl.
*A42B 7/00* (2006.01)

(52) U.S. Cl. ..... 2/421; 2/417; 2/419

(58) Field of Classification Search ..... 2/6.6, 2/415, 416, 417, 418, 419, 420, 421, 425
See application file for complete search history.

(56) References Cited

U.S. PATENT DOCUMENTS 4,044,400 A * 8/1977 Lewicki et al. ..... 2/241
4,075,715 A * 2/1978 Cowgill ..... 2/6.3
4,703,879 A * 11/1987 Kastendieck et al. ..... 2/422
4,856,119 A * 8/1989 Haberle ..... 2/417
4,884,301 A 12/1989 Aileo
5,079,780 A * 1/1992 Coombs et al. ..... 2/420
5,088,130 A * 2/1992 Chiarella ..... 2/411
5,121,508 A * 6/1992 Grilliot et al. ..... 2/421
5,315,718 A * 5/1994 Barson et al. ..... 2/418
5,581,819 A * 12/1996 Garneau ..... 2/421
5,638,551 A * 6/1997 Lallemand ..... 2/421
5,659,900 A 8/1997 Arney et al.
5,794,272 A * 8/1998 Workman et al. ..... 2/421
5,809,578 A * 9/1998 Williams ..... 2/421
5,898,950 A * 5/1999 Spyrou et al. ..... 2/421
5,983,405 A * 11/1999 Casale ..... 2/421
6,311,338 B1 * 11/2001 Galet ..... 2/421
6,425,142 B2 7/2002 Sasaki et al.
6,854,133 B2 * 2/2005 Lee et al. ..... 2/421

* cited by examiner

*Primary Examiner*—Rodney Lindsey
(74) *Attorney, Agent, or Firm*—Goodwin Procter LLP

(57) ABSTRACT

An improved retention system for a protective helmet comprises slide/coupling mechanisms on opposite sides of the helmet shell, and a movable element at the rear of the helmet. Fastening of the chinstrap secures the helmet in the downward direction and tightens the movable element against the nape of the neck, thereby securing the helmet in the area of the occipital lobe.

20 Claims, 7 Drawing Sheets

RETENTION SYSTEM FOR SAFETY HELMET

RELATED APPLICATION

The present application claims priority to, and the benefits of, U.S. Ser. No. 60/557,093, filed Mar. 26, 2004, the entire disclosure of which is hereby incorporated by reference.

FIELD OF THE INVENTION

This invention relates to safety helmets, in particular improvements in the retention system used to adjust and secure the helmet to the wearer's head.

BACKGROUND OF THE INVENTION

Helmets for head protection must fit a variety of head shapes and sizes. Once a helmet is adapted to a particular wearer's head by customizing or adjusting cushions and pads within the shell, straps attached to opposite sides are secured at the wearer's neck or chin to keep the helmet from falling off. Several refinements in retention systems for helmets, particularly mountain bike helmets, have been made in recent years. One such refinement involves an articulated member at the rear of the helmet, which contacts the wearer's head beneath the occipital region and thereby improving the stability of the helmet on the head; see, e.g., U.S. Pat. No. 5,659,900. This articulated member is retained elastically to the shell of the helmet, while a mechanically separate chinstrap is used to hold the helmet on the rider's head. This system improves the stability of the helmet, but requires the wearer to release or stretch the elastic strap holding the articulated member each time the helmet is put on the wearer's head. In other configurations, the articulated member is positioned by a spring element against the back of the wearer's neck; see, e.g., U.S. Pat. No. 6,425,142. In all such cases, the fit is not especially secure and/or is adjusted separately from the chinstrap each time the helmet is worn, an inconvenient operation.

Another approach utilizes a stabilizer mounted in the rear of the helmet to engage the nape of the neck of the wearer; see, e.g., U.S. Pat. No. 5,794,272. Secured by the helmet retention system, the stabilizer is attached via a strap to the chinstrap at a point below the wearer's ear. This allows a wearer to adjust the straps for his or her particular head shape once, and subsequently attach the helmet only by means of the chinstrap. When the chinstrap is released, the stabilizer is able to move rearward, facilitating removal of the helmet. When the helmet is to be worn again it is placed on the head with the stabilizer in the released position, and the chinstrap is then attached to secure both helmet and stabilizer.

While this approach requires one adjustment and then a single attachment action for repeat use, the adjustment for different fits is not easy. Moreover, the stabilizer is secured by connecting its strap to the chinstrap below the ear. This configuration is inconsistent with the most desirable tensioning direction of the stabilizer, namely, forward and upward against the head: pulling downward against the chinstrap is not the preferred direction, and the attachment point below the ear provides limited resistance to forces tending rotate and dislodge the helmet during use.

SUMMARY OF THE INVENTION

The present invention provides a forward and upward tension to a movable occipital lobe element while allowing the wearer to easily adjust and release this tension in conjunction with attaching the helmet with the chinstrap. In the present description we refer to any such articulated, pliable, hinged, or otherwise movable shape at the rear of the helmet that contacts the wearer's head (desirably beneath the occipital region) as a head-retention element.

In order to put on a helmet that incorporates a head-retention element, the straps or securing means for the head-retention element generally must be released. This is because the head-retention element in its secured position matches the undercut portion of the back of the head sufficiently to reduce the size of the opening in which the head is received. In accordance with the present invention, when the chinstrap is released, so is the tension on the head-retention element; and when the chinstrap is tightened and snapped, the head-retention element is tightened. This simultaneous action is achieved by a novel geometry in combination with a suitable attachment mechanism. In some embodiments, the chinstrap is able to tighten and release the head-retention element because it is routed through the attachment mechanism at the side of the helmet shell and then back to an attachment point on the head-retention element. The position of the attachment mechanism at the side of the shell can be varied according to different helmet attachment designs known in the art (e.g., single strap or two-point "Y" attachment), but by properly positioning the attachment mechanism, a strap between the attachment mechanism and the head-retention element can provide a tension for the head-retention element directed toward the frontal point of contact between the helmet and the wearer's forehead. This provides a secure fit.

In using a helmet in accordance with the present invention, the chinstrap is adjusted once to fit the size and shape of the wearer's head. This is done by placing the helmet in position as described below and adjusting the length of the straps by conventional adjusting means, e.g., a friction or toothed buckle. An advantage of the present invention is that the chinstrap works equally well secured at or below the chin. Repeat use of the helmet by the same wearer requires no further adjustment. When the helmet is to be put on, the straps coming from the opposite sides of the helmet are open and there is no tension on the head-retention element. The wearer places the helmet on his/her head. The wearer then takes each strap in his/her corresponding hand, pulls downward, and attaches them at the chin. This pulling action slides the strap within the attachment mechanism and tightens the head-retention element at the back of the neck. Hence the familiar action of securing the helmet against upward forces with the chinstrap also tightens the head-retention element to secure the helmet against rotation (particularly front-to-back rotation).

The ensuing discussion focuses on the geometry of a two-point "Y" retention strap in accordance with the invention, but it will be appreciated that this represents only one embodiment of the invention, which is amenable to numerous configurations—e.g., in conjunction with a full helmet having only a single retention strap. The retention straps are similar and symmetrical on opposite sides of the helmet, coming to a point of contact at the wearer's chin and joined by a clip or other releasable attachment device known in the art. The geometry of the retention straps on each side is in the form of a "Y." The middle junction point of the "Y" is fixed by a clip or by sewing the straps together such that they can flex, but cannot slide relative to one another. The strap that passes behind the wearer's ear is secured to the helmet by conventional means and holds the rear of the helmet against the wearers head. In a full helmet with only one strap, the rear strap is not needed as the material of the helmet shell itself rigidly attaches the rear of the helmet to the point where a single strap can provide a downward force. This single strap, or in the case of the "Y" configuration, the strap that passes in front of the wearer's ear, is routed through the attachment mechanism of the present invention to provide two functions: first, it secures the helmet downwardly against the wearer's head; and second, it passes through the attachment mechanism and then back to an attachment point on the head-retention element. When the chinstrap is pulled, a portion of it slides within the attachment mechanism and pulls the head-retention element forward and upward, pressing it against the nape of the wearer's neck. When the chinstrap is fastened at the neck or chin, the combination of the forward and upward tension on the head-retention element and the downward tension on the helmet shell provides a secure fit.

The attachment mechanism is secured to (or integral with) the side of the helmet shell. For example, the attachment mechanism may be co-molded with the plastic of the outer shell, or may instead be mechanically secured by rivet, bolt, or other conventional attachment means. The attachment mechanism provides a path for one member of the chinstrap to slide as its path changes direction from upward to rearward. This is accomplished by surfaces within the attachment mechanism that guide the sides of the strap, and a smooth rounded surface over which the strap slides. The attachment mechanism also provides a latching function that secures the helmet downwardly once the chinstraps have been joined. In a preferred embodiment, this latching function is provided by a parallel strap that rides over and frictionally secures the main or head-retention strap at the attachment mechanism. In another embodiment, latching is accomplished by means of a pinching action that frictionally engages the strap (e.g., by means of angular elements such as teeth or a pin acutely angled against the strap) when it is pulled downward and attached at the chin. In yet another embodiment, latching is accomplished by a movable element that binds against the strap after it has been adjusted by pulling downwardly. Any of these embodiments or their equivalents function to secure the helmet in the downward direction. (Were the latching mechanism not present, the strap that tightens the head-retention element could slide in either direction. Thus, if an upward force were applied to the rear of the helmet, the strap could slide back, loosening the head-retention element and allowing the helmet to pivot forward, becoming dislodged from the wearer's head.)

In a first aspect, therefore, the invention, comprises a safety helmet that includes a body configured to receive a wearer's head, a chinstrap, and a rear head-retention element responsive to the chinstrap such that tightening of the chinstrap draws the head-retention element in both forward and upward directions. In some embodiments, the body comprises a crown portion, a forward portion, a rear portion, and a cavity for receiving the wearer's head, and the head-retention element is located within the cavity at the rear portion of the helmet; in this way, tightening of the chinstrap draws the head-retention element toward both the crown portion and the forward portion.

The head-retention element may comprise a stabilizer configured to engage the rear of the wearer's head. In some embodiments, the stabilizer is engaged by a stabilizer strap mechanically continuous with the chinstrap. In other embodiments, the stabilizer is engaged by a stabilizer strap frictionally engaging the chinstrap. The chinstrap and the stabilizer strap may be a single continuous strap, or may instead comprise multiple straps in a Y configuration. In preferred embodiments, tightening of the chinstrap places tension on the stabilizer strap that resists relaxation despite release of the chinstrap. The tension may be maintained, for example, by a latch.

In another aspect, the invention comprises a method of securing a safety helmet. The method comprises the steps of providing a safety helmet comprising a body configured to receive a wearer's head, a chinstrap, and a rear head-retention element, and, with the wearer's head within the body, tightening the chinstrap so as to draw the head-retention element in both forward and upward directions, thereby securing the safety helmet.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION

Figure 1:
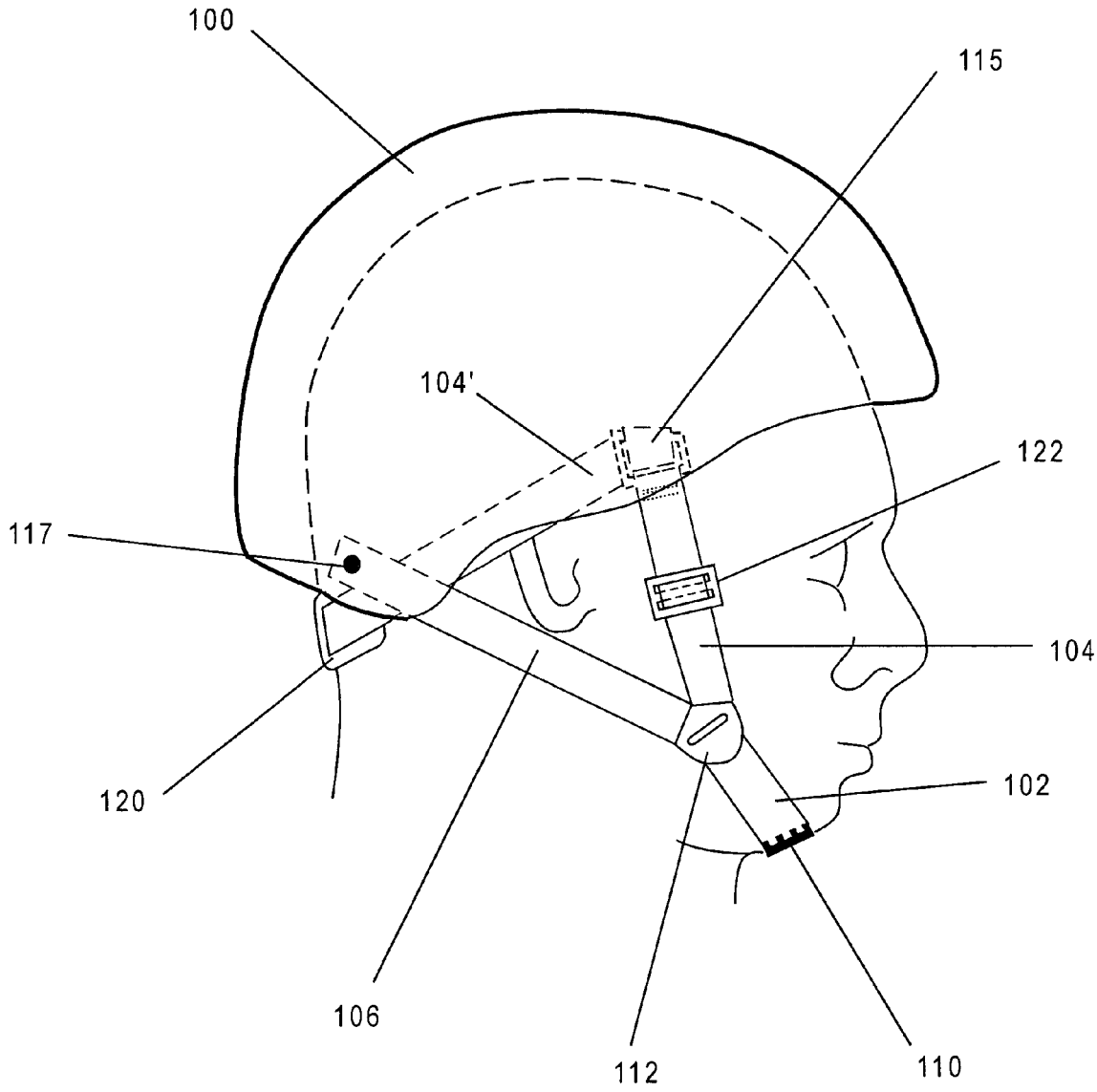
FIG. 1 is an elevation showing the right side of a protective helmet with retention straps in accordance with the present invention.

With reference to FIG. 1, a helmet shell 100 is shown from the right side of the wearer's head (the left side having symmetrical features and configuration). Flexible straps 102, 104, 106 form a "Y" configuration and are joined with matching straps (not shown) on the opposite side of the helmet and attached at the neck or chin with an adjustable buckle 110 of conventional design. The middle junction point 112 of the retention straps is fixed by a clip or by sewing the straps 102, 104, 106 together such that they can flex, but cannot slide relative to one another. The retention strap 104 is secured to an attachment-mechanism coupling 115 at a point forward of the wearer's ear. The other upward strap 106 is secured to the helmet 100 at a rearward attachment point 117 behind the wearer's ear; engagement of strap 106 to the helmet at point 117 preferably occurs at the inside surface the helmet shell 100 by means of, for example, a rivet or other retention element. An adjusting strap 104' slidably engages a head-retention element 120 and extends forward through the coupling 115 and then downward, where it is secured to strap 104 by means of an adjustment mechanism 122. When strap 102 is pulled downward, strap 104' slides around the coupling 115 and, due to the geometry of its path, pulls the head-retention element 120 forward and upward until it presses against the nape of the wearer's neck. When strap 102 is secured to the corresponding strap on the opposite side of the helmet and joined at the chin coupling 110, the combination of the forward and upward tension on the head-retention element 120 created by strap 104' and the downward tension on the helmet shell 100 created by straps 104, 106 provides a secure fit.

Figure 2:
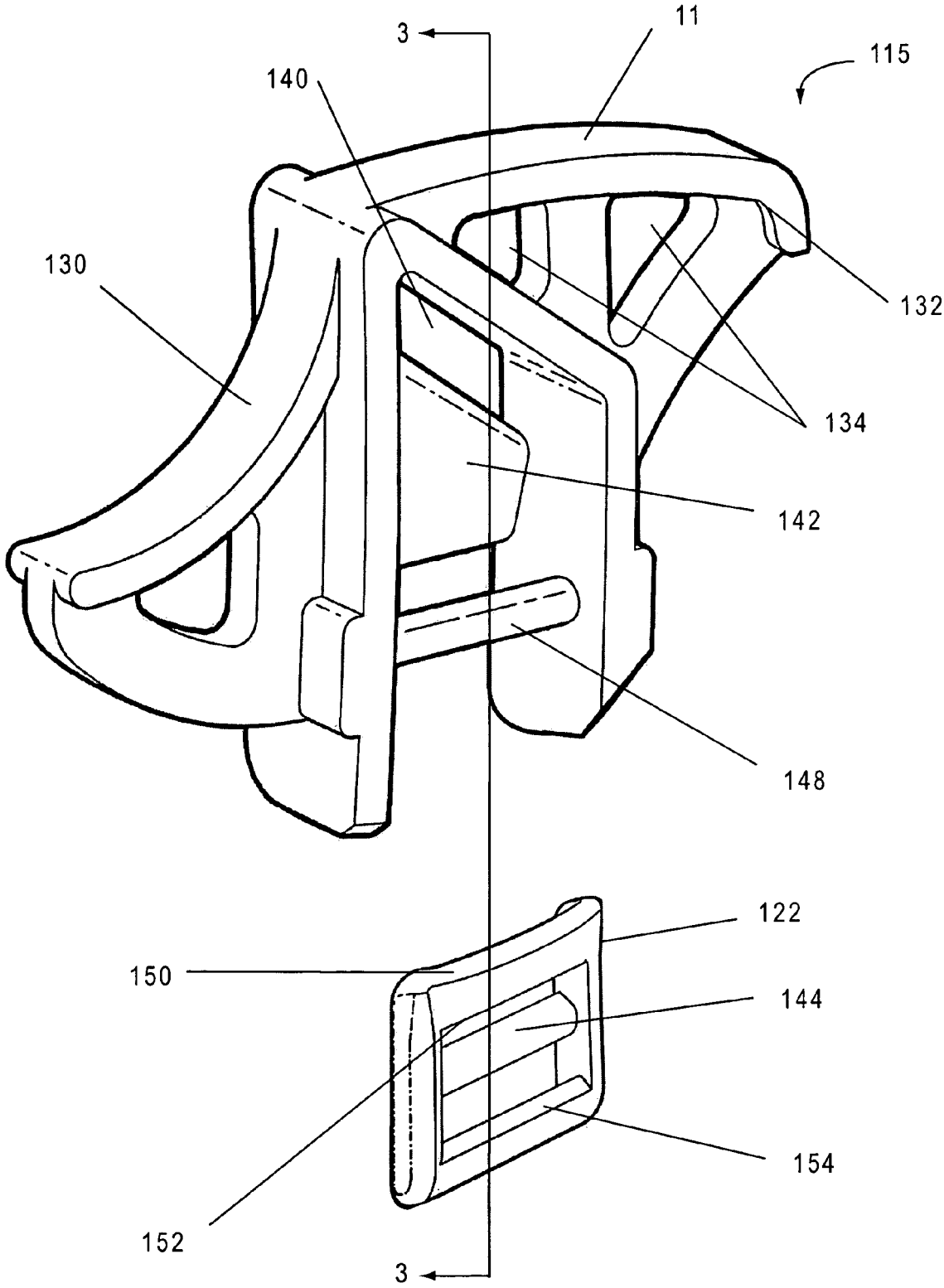
FIG. 2 is a perspective view showing the attachment mechanism removed from the right side of the helmet (with the retention strap omitted for clarity)

With reference to FIG. 2, one embodiment of the attachment mechanism coupling 115 is shown separated from the helmet (the right-side coupling is illustrated; the left-side coupling has symmetrical features). The illustrated embodiment of attachment mechanism 115 is formed with curved engagement surfaces 130, 132 that secure it to or within the side of the helmet shell 100. Angular features 132 and/or holes 134 are provided so that the attachment mechanism 115 can be co-molded with the plastic of the outer shell 100. These features 132, 134 serve as a scaffold into which plastic may flow during fabrication, thereby imparting mechanical strength to the attachment. Alternatively, the attachment mechanism 115 can be secured to the outer shell 100 by conventional means such as by rivet or bolt.

Figure 3:
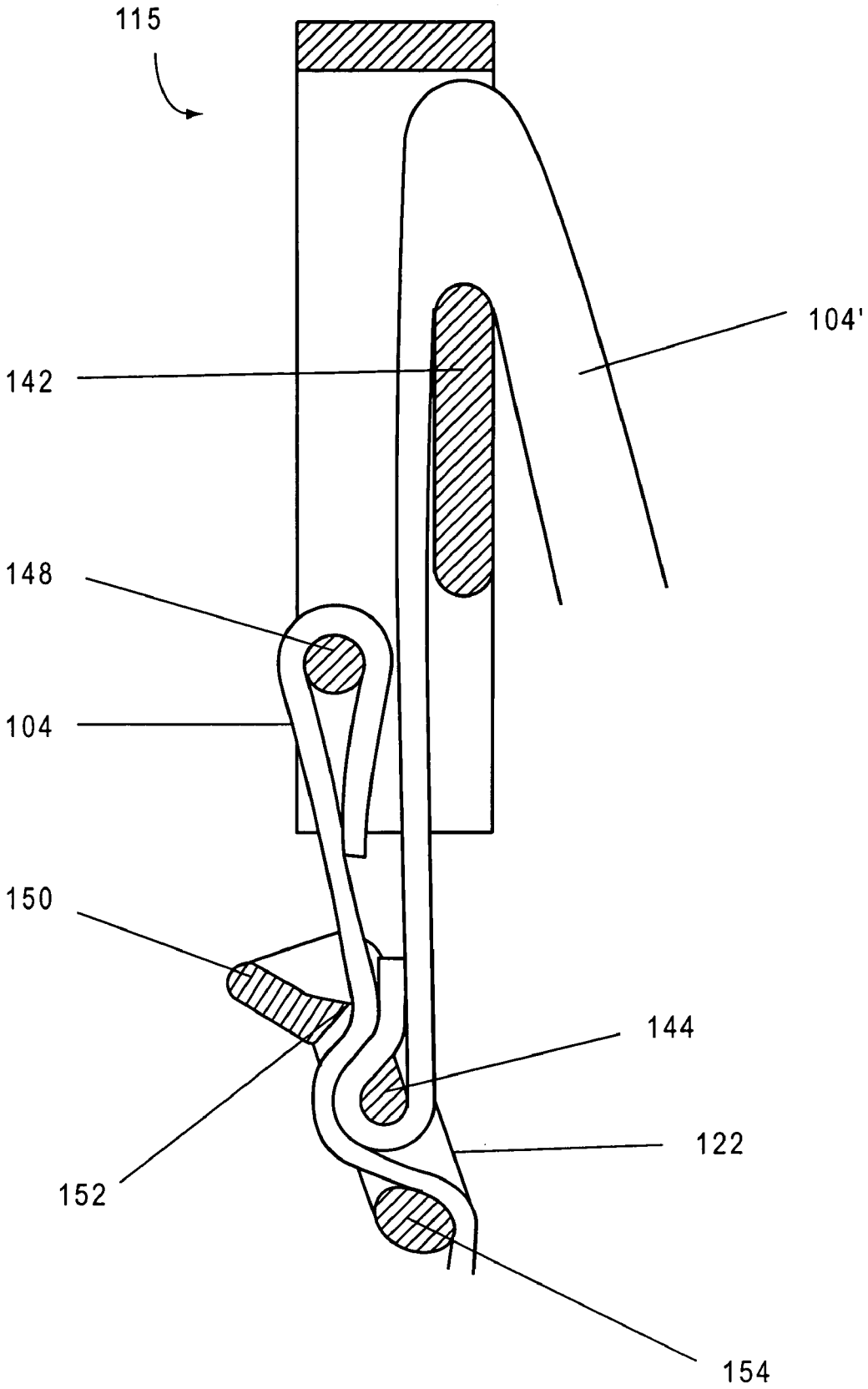
FIG. 3 is a sectional view of the attachment mechanism shown in FIG. 2, taken along the line 3—3.

The path of the retention strap through the open area 140 and over a smooth rounded surface 142 is best understood in connection with FIGS. 1 and 3, the latter illustrating a section of a preferred embodiment of the right-side attachment mechanism 115. The portion of the retention strap 104' coming from the head-retention element 120 is shown schematically as it passes over the angled element 142 and downward to adjustment mechanism 122 and attaches to a pin 144. A second portion of the retention strap 104 extending from the middle junction point 112 passes upwards through adjustment mechanism 122 and attaches to a pin 148. In using the present invention, the wearer places the helmet on his/her head and adjusts the straps 104, symmetrical on left and right sides of the helmet, by means of adjusting buckle 110 to fit snugly at the chin. The wearer then pulls downward on adjustment mechanism 122 by placing pressure on the locking tab 150, thereby causing adjustment mechanism 122 to slide downward along strap 104, pulling strap 104' due to its fixed attachment at pin 144. The pulling action on strap 104' tightens the head-retention element 120 at the back of the wearer's neck. The wearer then lowers and attaches straps 104 at the chin. In this downward orientation strap 104 is forced against strap 104' at the angled surface 152 of locking tab 150. This contact by surface 152 cooperates with a fixed pin 154 to frictionally engage straps 104, 104' and thereby prevent strap 104' from sliding back from the position obtained from the tightening pull.

Figure 4:
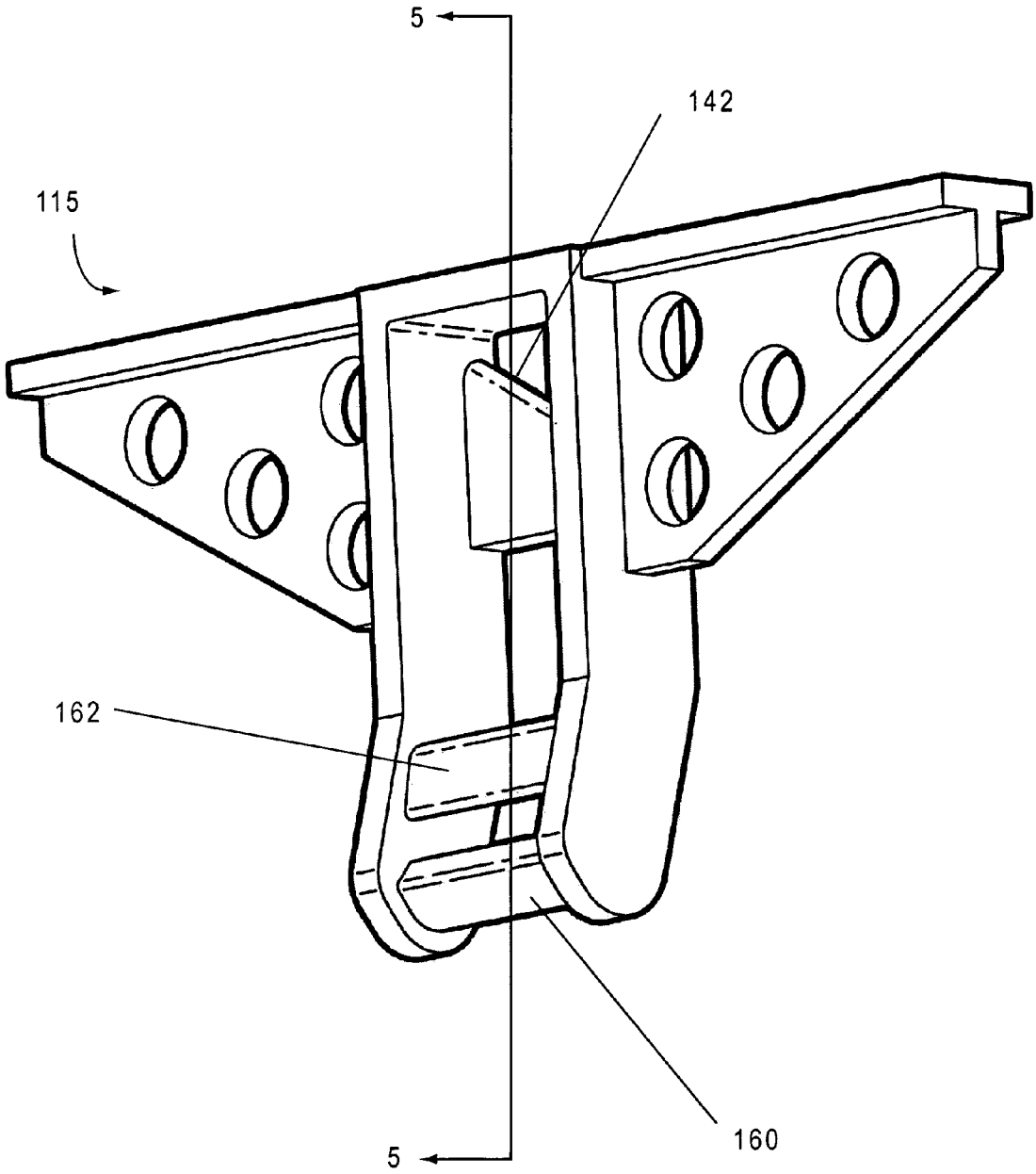
FIG. 4 is a perspective view showing another embodiment of the attachment mechanism, once again removed from the right side of the helmet and with the retention strap omitted for clarity.
Figure 5:
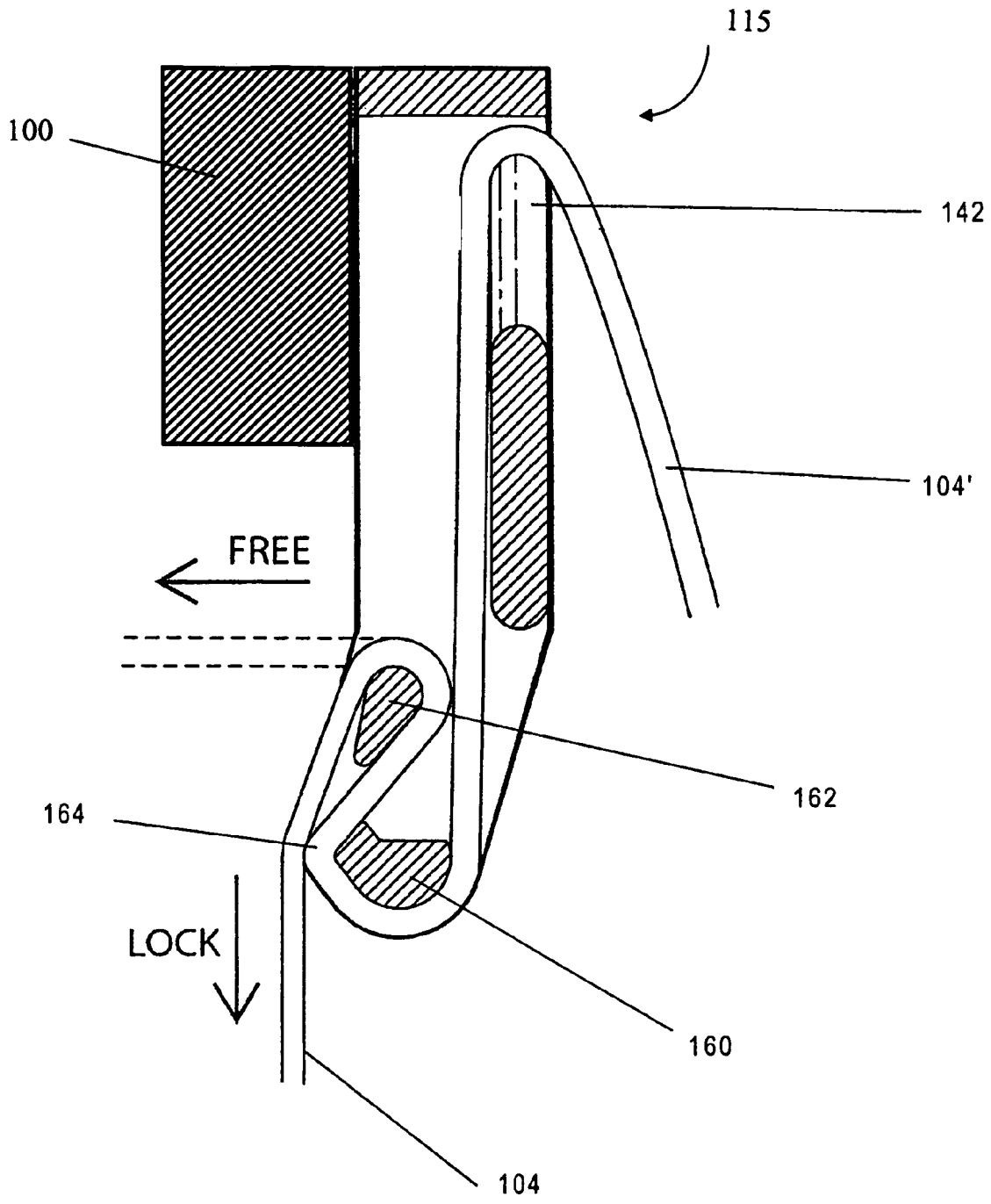
FIG. 5 is a sectional view of the attachment mechanism shown in FIG. 4, taken along the line 5—5.

FIGS. 4 and 5 illustrate another embodiment of the attachment mechanism coupling 115. In this embodiment, straps 104 and 104' are different portions of the same continuous strap and will be denoted as 104–104' (where the reference numeral 104 refers to the end of the strap going to the chinstrap and 104' refers to the end connecting to the head-retention element 120). The element of the retention strap 104–104' coming from the head-retention element 120 is shown schematically as it passes over the rounded surface 142 and extends downward to pass around a pair of guide bars 160, 162. Bar 160 has an angular profile terminating in an angled projection 164 facing outwardly with respect to the helmet. The strap 104–104' passes over this angled profile and then around bar 162, and finally to the chinstrap buckle 110 (see FIG. 1). This outward end of strap 104–104' can be pulled by the wearer in the direction of the "Free" arrow, or downward in the direction of the "Lock" arrow. In using the present invention, the wearer places the helmet on his/her head and pulls the strap 104–104' (symmetrical straps on left and right sides) away from the head in the direction of the "Free" arrow. At this angle the strap is able to freely slide over the surface 142 and bars 160, 162, and the pulling action tightens the head-retention element 120 at the back of the neck (see FIG. 1). The strap 104–104' is then lowered in the direction of the "Lock" arrow and attached at the chin. In the downward "Lock" position, strap 104–104' is forced against itself and angled surface 164 of bar 160. This contact frictionally engages the strap so it cannot slide back from the position obtained in the tightening pull.

Figure 6:
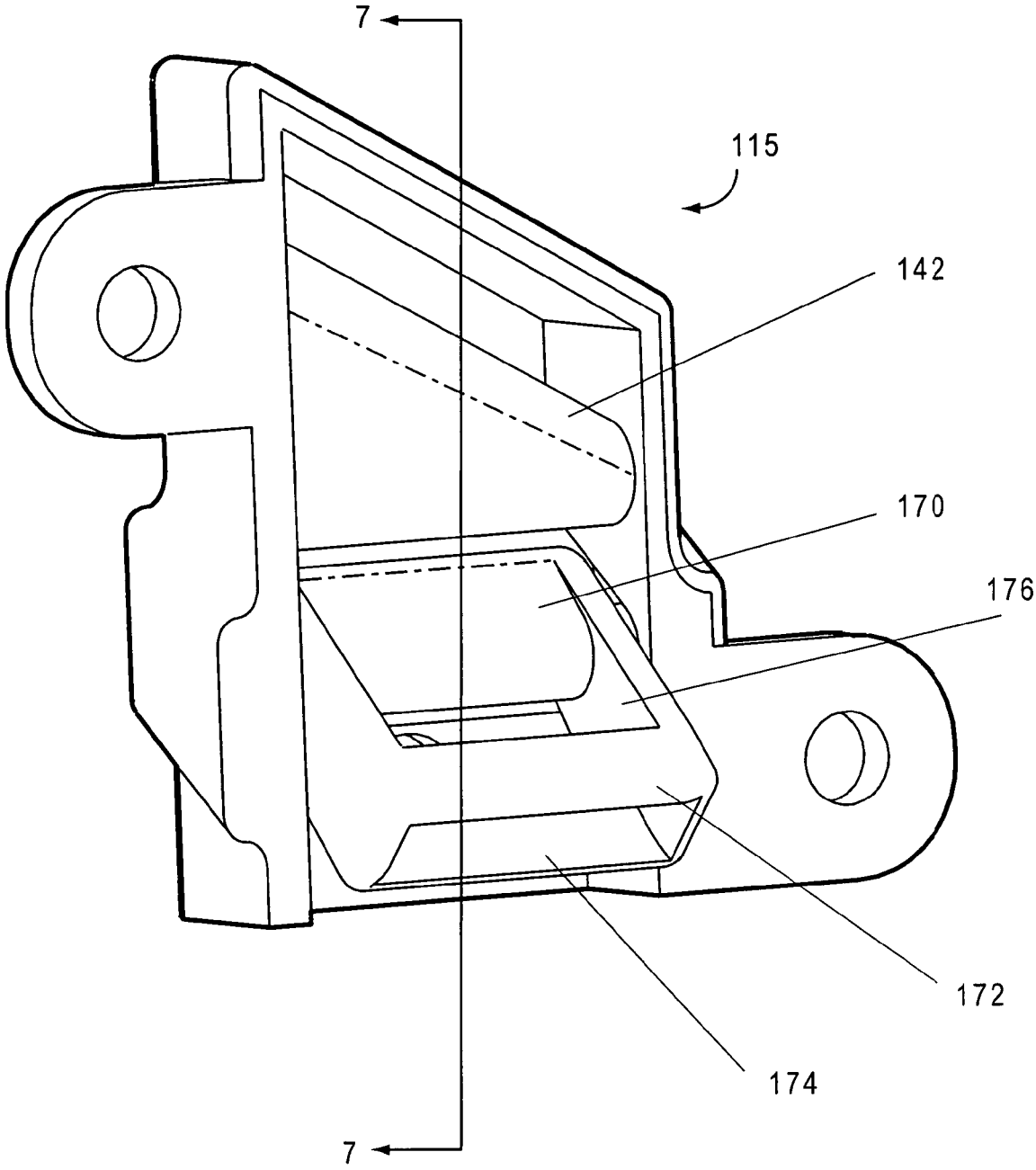
FIG. 6 is a perspective view showing another embodiment of the attachment mechanism, once again removed from the right side of the helmet and with the retention strap omitted for clarity.
Figures 7A, 7B:
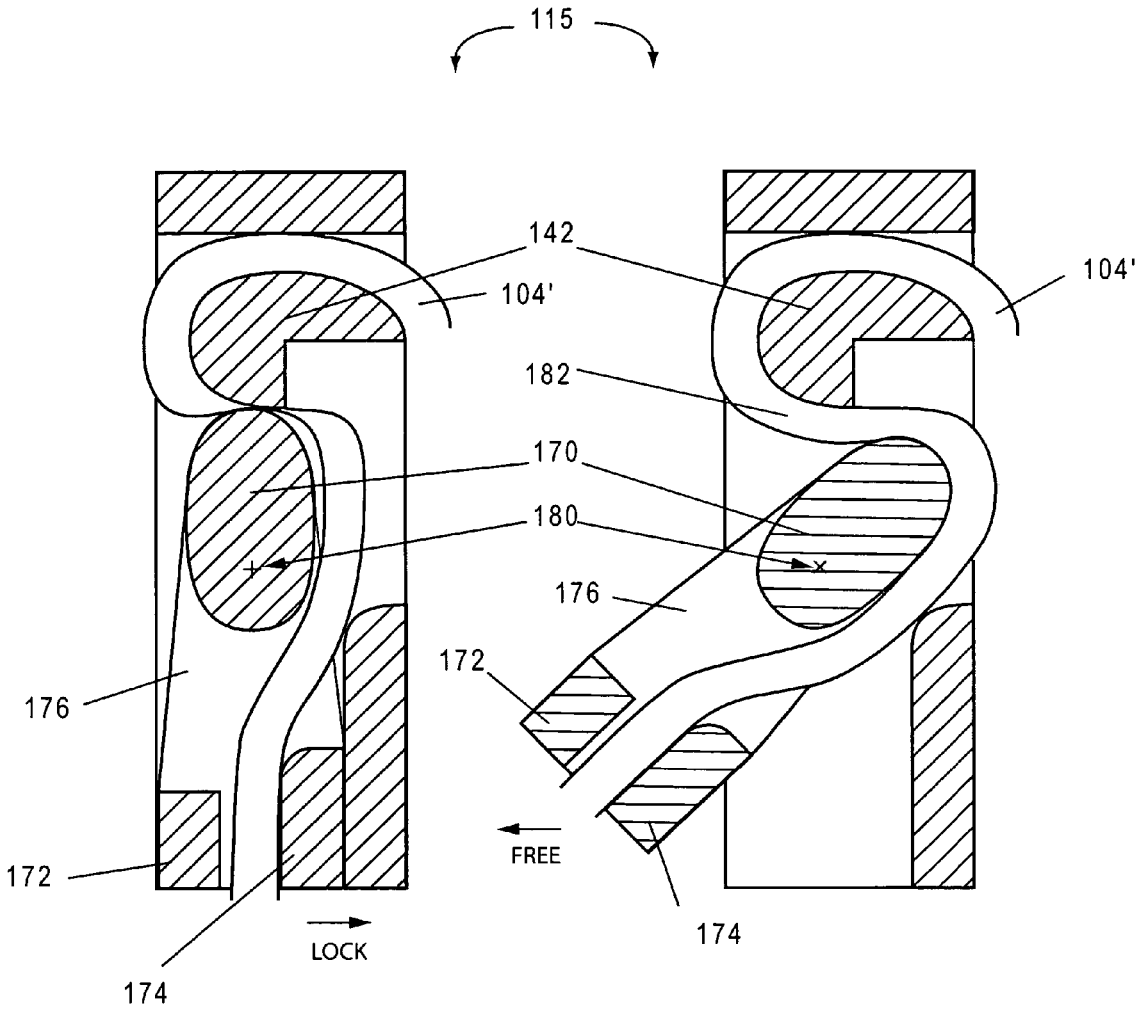
FIGS. 7A and 7B are sectional views of the attachment mechanism shown in FIG. 6, taken along the line 7—7, in locked and free configurations, respectively.

FIGS. 6, 7A and 7B illustrate yet another embodiment of the attachment mechanism coupling 115. In this embodiment, straps 104 and 104' are different portions of the same continuous strap and once again will be denoted as 104–104'. The portion of the retention strap 104–104' coming from the head-retention element 120 is shown schematically as it passes over the angled element 142 and then extends downward to pass around a pivotable pin 170 and through a pair of guide posts 172, 174. Pin 170 and guide posts 172, 174 are part of a rotating assembly 176 that rotates about a pivot point 180. Assembly 176 is shown in a "Free" position in FIG. 7B and a "Lock" position in FIG. 7A. The strap 104–104' passes through a narrow passage 182 between pins 142, 170. In using the helmet incorporating this attachment mechanism, the wearer places the helmet on his/her head and pulls the strap 104–104' on left and right sides of the helmet away from the head in the direction of the "Free" arrow. The angle of this pulling action causes the assembly 176 to rotate outward to the position shown in FIG. 7B. In this position, the strap 104–104' is free to slide over the pins 142, 170 and the pulling action tightens the head-retention element 120 at the back of the neck (see FIG. 1). The strap 104–104' is then lowered in the direction of the "Lock" arrow and attached at the chin. This downward motion rotates the assembly 176 to the "Lock" position shown in FIG. 7A, in which strap 104–104' is pinched in the narrow space 182. This pinching action frictionally engages the strap, preventing it from sliding back from the position obtained in the tightening pull.

Having described certain embodiments of the invention, it will be apparent to those of ordinary skill in the art that other embodiments incorporating the concepts disclosed herein may be used without departing from the spirit and scope of the invention. The described embodiments are to be considered in all respects as only illustrative and not restrictive.

The invention claimed is:

1. A safety helmet comprising:

a. a body configured to receive a wearer's bead;

b. a chinstrap;

c. a stabilizer strap;

d. a rear head-retention element responsive to the chinstrap and the stabilizer strap such that (i) tightening of the chinstrap draws the head-retention element in both forward and upward directions and (ii) adjustment of the stabilizer strap changes a tension on the head-retention element; and e. an adjustment mechanism, at an end of the stabilizer strap, for changing the tension on the head-retention element without affecting the chinstrap.

2. The safety helmet of claim 1 wherein the body comprises a crown portion, a forward portion, a rear portion, and a cavity for receiving the wearer's head, the head-retention element being located within the cavity at the rear portion of the helmet, tightening of the chinstrap drawing the head-retention element toward both the crown portion and the forward portion.

3. The safety helmet of claim 1 wherein the head-retention element comprises a stabilizer configured to engage the rear of the wearer's head.

4. The safety helmet of claim 3 wherein the stabilizer is engaged by the stabilizer strap.

5. The safety helmet of claim 3 wherein the stabilizer strap frictionally engages the chinstrap.

6. The safety helmet of claim 1 wherein the chinstrap comprises multiple straps in a Y configuration.

7. The safety helmet of claim 1 wherein the head-retention element is engaged by the stabilizer strap, tightening of the chinstrap placing tension on the stabilizer strap.

8. The safety helmet of claim 1 wherein the adjustment mechanism comprises a latch.

9. The safety helmet of claim 8 wherein the latch comprises a parallel strap frictionally engaging the stabilizer strap.

10. The safety helmet of claim 8 wherein the latch comprises angular elements that engage the stabilizer strap.

11. The safety helmet of claim 8 wherein the latch comprises a locking element that secures the stabilizer strap.

12. A method of securing a safety helmet, the method comprising the steps of:

a. providing a safety helmet comprising a body configured to receive a wearer's head, a chinstrap, a stabilizer swap, an adjustment mechanism at an end of the stabilizer strap, and a rear head-retention element; and b. with the wearer's head within the body, tightening the chinstrap so as to secure the safety helmet to the wearer's head, and using the adjustment mechanism, adjusting a tension on the head-retention element to draw the head-retention element in both forward and upward directions without affecting the chinstrap.

13. The method of claim 12, wherein tightening of the chinstrap places tension on the stabilizer strap.

14. The method of claim 12, wherein the adjustment mechanism is slidably engaged with the chinstrap.

15. The method of claim 12, wherein the tension on the stabilizer strap is adjusted by sliding the adjustment mechanism along the chinstrap.

16. A safety helmet comprising:

a. a body configured to receive a wearer's head;

b. a chinstrap; and c. a rear head-retention element responsive to the chinstrap such that tightening of the chinstrap draws the head-retention element in both forward and upward directions;

wherein the chinstrap comprises a plurality of strap legs in at least two Y configurations, ends of two legs of each Y configuration being attached to the body of the safety helmet.

17. The safety helmet of claim 16 wherein the chinstrap is adjustable with respect to one of the attached legs.

18. The safety helmet of claim 16 further comprising an adjustment mechanism.

19. The safety helmet of claim 18 wherein the adjustment mechanism facilitates adjusting a tension on the head-retention element without affecting the chinstrap.

20. The safety helmet of claim 16 wherein the strap legs form two Y configurations.

* * * * *